United States Patent [19]

Ballesteros

[11] 4,104,435

[45] Aug. 1, 1978

[54] SPONGE

[75] Inventor: Juan Carlos Corral Ballesteros, Buenos Aires, Argentina

[73] Assignee: Suilene Argentina S.A., Buenos Aires, Argentina

[21] Appl. No.: 795,753

[22] Filed: May 11, 1977

[30] Foreign Application Priority Data

May 28, 1976 [AR] Argentina ..... 263437

[51] Int. Cl.[2] ..... D04H 1/68; B32B 3/26; B32B 5/20

[52] U.S. Cl. ..... 428/288; 15/209 R; 428/296; 428/297; 428/317; 428/425; 427/244

[58] Field of Search ..... 15/209 R, 209 C; 428/288, 296, 297, 304, 305, 310, 317, 289, 290, 311, 425; 427/243, 244

[56] References Cited

U.S. PATENT DOCUMENTS

| | | | |
|---|---|---|---|
| 3,362,862 | 1/1968 | King | 428/310 |
| 3,464,872 | 9/1969 | Everett | 428/425 |
| 3,861,993 | 1/1975 | Guthrie | 428/425 |
| 3,974,319 | 8/1976 | Alibeckoff | 428/288 |

*Primary Examiner*—William J. Van Balen
*Attorney, Agent, or Firm*—Stonebraker, Shepard & Stephens

[57] ABSTRACT

A sponge includes a three-dimensional fibrous reticular structure formed of fibers randomly arranged and connected to each other at points where they intersect, and a body of compressibly resilient foamed material formed around the fibrous structure to fill and engulf the fibrous structure with the foamed material intimately bonded to the fibers to form an integral and resilient sponge. Portions of the fibers extend outward from at least one surface of the sponge, and the fiber structure is stronger and more abrasive than the foamed material. Also, the ratio by weight of the foamed material to the total weight including the fibrous structure ranges from 20 to 80%.

5 Claims, 4 Drawing Figures

SPONGE

BACKGROUND OF THE INVENTION

Synthetic sponges for washing or cleaning purposes are formed of foamed synthetic or cellulose resins, such as polyurethane foams, and are widely used for scrubbing and cleaning and to hold water and soap emulsions or detergents in their open cells. Such sponges wear relatively rapidly and are easily broken or torn, because suitable foamed material having thin and weak connections between open cells is not very strong or durable. Increasing the strength of synthetic sponges has been attempted by varying the foamed composition and the dimensions of the open cells. Wear problems remain, however, and the best prior art sponges deteriorate rapidly within a few months of use, especially when used for scrubbing or scouring.

As another example of prior art sponge problems, paint rollers made of foamed material deteriorate after a few weeks of use from the stresses produced by the viscosity of the paint held in the cells of the sponge material.

Also known in the art are fibrous abrasive cloths used as scrubbing or scouring pads that are relatively durable, but do not have sponge characteristics. They cannot absorb and retain water or detergents or soap emulsions, and do not afford a spongy and yielding mass. Fiber cloths and sponges have been combined by securing a fiber cloth to one face surface of a sponge. The sponge then absorbs and holds water and cleaning materials, and the fiber cloth provides an abrasive scouring pad, but each has an independently useful life.

The invention involves recogntion of the problems of prior art sponges, fiber cloths, and other cleaning and scouring devices and an appreciation of a way of substantially improving on these devices to produce a sponge that is durable and has an abrasive capacity combined with dimensional stability, resistance to deflocculation, and resistance to wear, tears, and cuts. The invention aims at an integral and composite sponge body having both absorbent and abrasive characteristics throughout practically its entire volume and being durable and wear resistant throughout its body. The invention also aims at economy and functional effectiveness in a sponge that is stronger and more wear resistant and also has more abrasive scouring surfaces.

SUMMARY OF THE INVENTION

The inventive sponge includes a three-dimensional fibrous reticular structure formed of a plurality of fibers randomly arranged in a three-dimensional relationship to provide a predetermined fiber density wherein at least some of the fibers are connected to each other at points where the fibers intersect. The sponge also includes a body of compressibly resilient foamed material formed around the fibrous reticular structure to fill the spaces in the structure and engulf the structure in the sponge body with the foamed material intimately bonded to the fibers to form an integral and resilient sponge combining the fibrous structure with the foamed material so that the fibrous structure moves resiliently with the foamed material. Portions of the fibers extend outward from at least one surface of the sponge, the fibrous structure is stronger and more abrasive than the foamed material, and the ratio by weight of the foamed material to the total weight including the fibrous structure ranges from 20 to 80%.

The fibrous structure strengthens and improves the wear resistance of the foamed material and also provides abrasive resistance at the sponge's surfaces, and the foamed material provides spongey and absorbent characteristics for holding water and cleaning materials. The foamed material prevents the fibrous structure from being torn apart or deformed enough to impair its usefulness, and the fibrous structure gives the foamed material mechanical strength so that the two materials are mutually preservative and give the sponge a long and effective life.

DESCRIPTION OF THE PREFERRED EMBODIMENT

Figure 2:
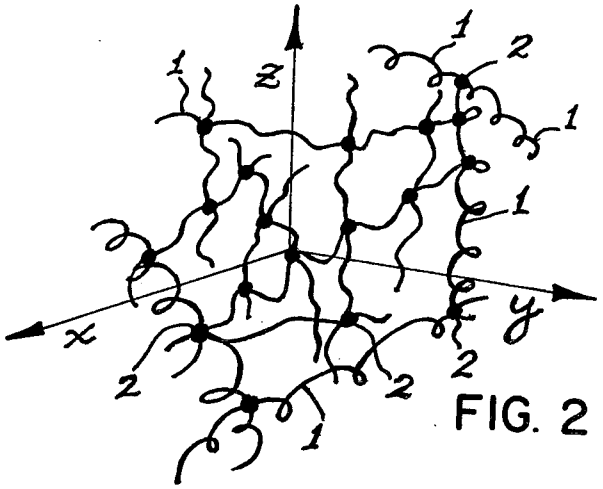
FIG. 2 is an enlarged view of the reticular fibrous structure of FIG. 1 arranged relative to XYZ coordinates.
Figure 1:
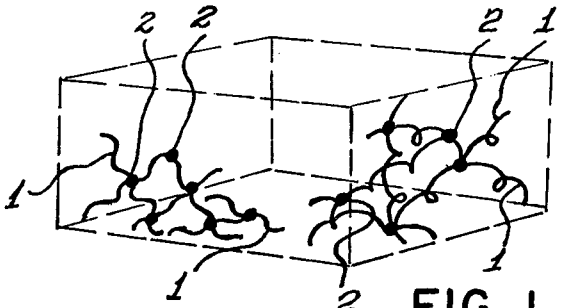
FIG. 1 is a partially schematic perspective view of a three-dimensional reticular fibrous structure used in making the sponge of the present invention.

FIGS. 1 and 2 show three-dimensional fibrous reticular structures that are made by methods that are generally known in the art. Fiber lengths 1 are arranged randomly in a three-dimensional space and intersect each other at points 2. Where the fibers 1 cross each other and touch each other at intersecting points 2, they are connected together by welding, fusing, or other means, and are otherwise flexibly free to move between the interconnecting points 2. Many different types of fibers can be used to form a three-dimensional reticulated structure as illustrated, and these include synthetic resinous fibers of polymeric material, vegetable fibers, animal fibers, glass fibers, metallic fibers, and metal wool materials, and the fibers can be interconnected in various ways. One preferred way of joining the fibers together at their points of mutual contact is by spraying the fibers with resins that bond them together. Fiber fusion or welding is also possible, and a known mechanical "needle punch" method can be used for securing metallic fibers together. The way of securing the fibers together is partially determined by the material of the fibers themselves, as is generally known.

Fibers that are preferred for use in the sponge of the present invention include polyamide (1.5–60 denier), polyester (1.5–60 denier), or acrylic (1.5–15 denier), or fibers formed of polypropylene, cellulose, or natural fibers, or any mixtures of different fibrous materials. The fibers are preferably welded together by spraying them with acrylic, vinyl, or acrylonitrile resins, which produces a flexible, three-dimensional reticular fibrous structure that is wear resistant.

Figure 4:
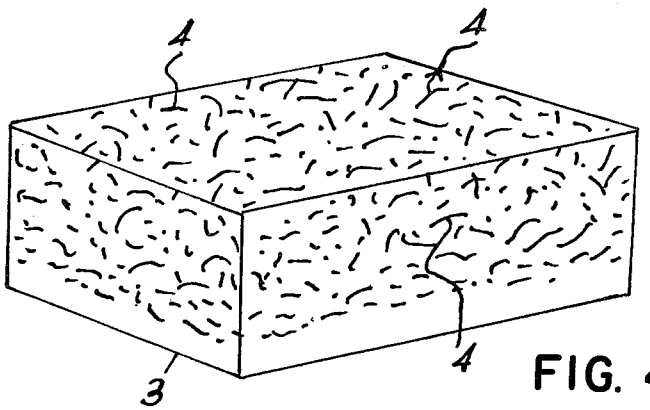
FIG. 4 is a perspective view of a preferred embodiment of the sponge.
Figure 3:
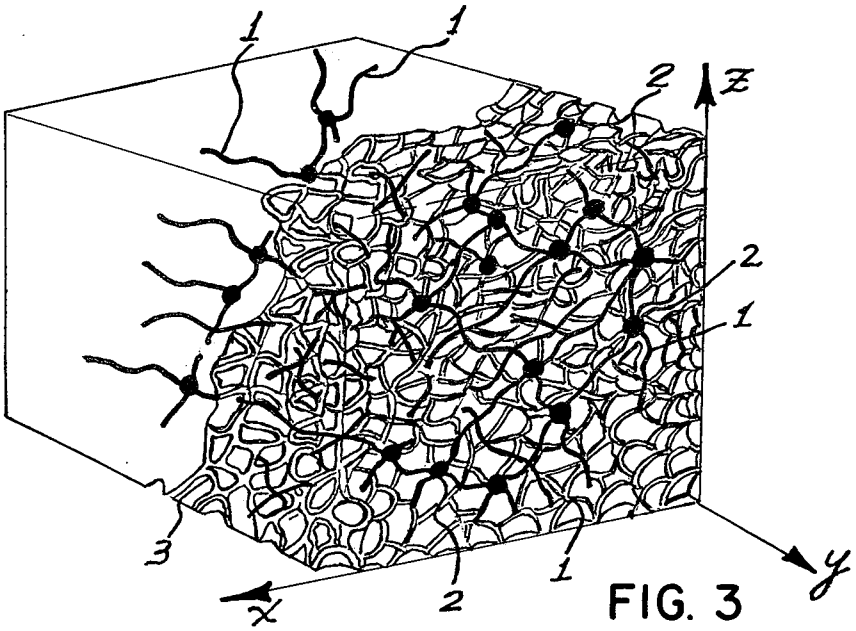
FIG. 3 is a partially schematic perspective view of a sponge made according to the invention and illustrated relative to XYZ coordinates.

The reticular fibrous structure of FIGS. 1 and 2 is arranged within an open-cell, foamed material to form a complete sponge as shown in FIGS. 3 and 4. The foamed material is preferably formed around the fibrous structure to fill the spaces in the fibrous structure and engulf the fibrous structure, and the foamed material is intimately bonded to all the fibers to form an integral and resilient sponge. The foamed material is preferably resinous, and preferably formed of a synthetic and polymeric resin material such as a polyurethane (polyether or polyester), and acrylic, vinyl, or a synthetic latex (acrylonitrile-butadiene or butadiene-styrene). The foamed material is preferably foamed around the fibrous structure to be coextensive with the fibrous structure as illustrated to form a resiliently compressible foamed mass 3 engulfing the fibrous structure. The foamed material prevents objects from penetrating into the fibrous structure where the fibers or their interconnections might be broken and thus prevents damage to the fibrous structure. In turn, the fibrous structure strengthens and prevents tearing and wear damage to the foamed material 3 while moving intimately and resiliently with the foamed material to function as an absorber of water and cleaning materials.

The fibrous structure and the foamed material can vary in weight relative to each other ranging from 20% foamed material and 80% fibrous material, to 80% foamed material and 20% fibrous material. The particular weight proportions selected depend upon the desired emphasis on strength and abrasive properties compared to yielding and absorbent properties.

Fiber ends or portions 4 extend outward from the working faces of the sponge in outcroppings best shown in FIG. 4 to provide an enhanced abrasive or scouring surface for the sponge. Furthermore, as the sponge surface wears away, more fiber outcroppings 4 are exposed as the sponge wears inward so that the scrubbing or scouring surface of the sponge is constantly renewed with wear to have the same working characteristics throughout its life. As the sponge body 3 expands, contracts, and resiliently deforms, the intimate bonding of the foamed body 3 with the fibrous structure reduces the extent of the deformations and prevents any extreme localized mechanical variations in strength to enhance durability. This improves substantially over prior art devices having a fiber cloth bonded to a surface of a sponge body where the fibrous material and the sponge material have relatively independent lives. The sponge material becomes softer and more flexible when wetted, and yet the fibrous material does not, and this produces stress in devices having separate foamed material and fibrous structures that are simply bonded together. These problems are overcome in the inventive sponge having the fibrous structure intimately bonded to and extending throughout at least a substantial portion of the foamed material so that both the fibrous structure and the foamed material move and work in close and intimate association with each other.

In addition to cleaning, scrubbing and scouring work, the sponge can be used as a filter medium for many types of filters, as a cloth or tapestry, because of its non-deformability and resistance to cutting, or as a packing material, because of its resilience and resistance to impact, and in other industrial applications in which a sponge product of great mechanical and dimensional stability and durability is required.

The sponge in accordance with the present invention can be made in several different ways. One preferred way is to prepare a mixture of the proper chemical components to form an open-cell foamed body, and to pour these components continuously onto a slightly inclined plane that is limited in width and height. At the same time, the three-dimensional reticulated fibrous structure in a shape having a height and width corresponding to the height and width of the finished sponge is fed into the upper portion of the foam mixture to extend throughout the width of the foamed mixture and proceed at the same speed of advance. The foam then flows and forms around the fibrous structure and penetrates gradually into the fibrous structure during the foaming process so that when the foaming is complete, the fibrous structure is fully engulfed in foamed material and completely incorporated within the foamed sponge body. The solidification and drying that is appropriate to the particular foamed material then proceeds as generally known. The finished sponge can vary in density between 50 kg/m$^3$ to 75 kg/m$^3$ or more, depending on the density of the foam and the fibrous structure.

The same general method can be used to produce a sponge having an internal fibrous structure that does not extend for the full height of the finished sponge. This leaves unreinforced foamed material exposed for a predetermined depth along one surface of the completed sponge, and a fibrous structure embedded into the opposite surface of the sponge to a predetermined depth. The final product then has a typically yielding sponge characteristic on one surface, and a strengthened and fiber reinforced sponge characteristic on an opposite surface.

The sponge can also be molded, rather than formed continuously, and fibers can be arranged to outcrop or extend from different faces of the completed sponge as desired. The outcropping fibers are firmly and fully anchored within the foamed material to increase the abrasion resistance of the sponge surface from which they extend.

The following table shows comparable physical properties for different preferred embodiments of the sponge made with different materials.

COMPARISON OF PHYSICAL PROPERTIES OF POLYURETHANE FOAMS

| | Polyether | | Polyester | | Present Invention | | |
|---|---|---|---|---|---|---|---|
| Density | 26 | 30 | 26 | 31 | 60 | 70 | Kg/M$^3$ |
| Tensile Strength | 1.48 | 1.52 | 1.45 | 1.60 | 3.8 | 4.8 | Kg/cm$^2$ |
| Resistance to Tear | 700 | 715 | 770 | 790 | 4580 | 5700 | gr/cm |
| Resistance to Compression | 20 | | 27 | | 70 | | 25% |
| | 27 | | 38 | | 221 | | 50% |
| | 37 | | 53 | | 316 | | 65% |
| Temporary Swelling | 30% | 25% | 25% | 28% | 4% | | Oil of turpentine trichlor-ethylene |

What is claimed is:

1. A sponge comprising:

a. a three-dimensional fibrous reticular structure formed of a plurality of fibers randomly arranged in a three-dimensional relationship to provide a predetermined fiber density, at least some of said fibers being connected to each other at points where said fibers intersect;

b. a body of compressibly resilient foamed material formed around said fibrous reticular structure to fill spaces in said structure and engulf said structure, said foamed material being intimately bonded to said fibers to form an integral and resilient sponge combining said fibrous structure with said foamed material so that said fibrous structure moves resiliently with said foamed material;

c. portions of said fibers extending outward from at least one surface of said sponge;

d. said fibrous structure being stronger and more abrasive than said foamed material; and e. the ratio by weight of said foamed material relative to total weight of said sponge including said fibrous structure ranging from 20 to 80%.

2. The sponge of claim 1 wherein said fibrous structure is located within said foamed material to be spaced from one surface of said sponge, and said fibers extend outward from other surfaces of said sponge.

3. The sponge of claim 2 wherein said foamed material is a resin.

4. The sponge of claim 1 wherein said foamed material is a resin.

5. The sponge of claim 1 wherein said fibers are selected from the group consisting of polymeric fibers, vegetable fibers, animal fibers, glass fibers, and metal fibers.

* * * * *